US007789625B2

(12) United States Patent
Liang

(10) Patent No.: US 7,789,625 B2
(45) Date of Patent: Sep. 7, 2010

(54) TURBINE AIRFOIL WITH ENHANCED COOLING

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 725 days.

(21) Appl. No.: 11/800,800

(22) Filed: May 7, 2007

(65) Prior Publication Data

US 2008/0279697 A1 Nov. 13, 2008

(51) Int. Cl.
*F01D 5/08* (2006.01)

(52) U.S. Cl. ..... 416/97 R; 415/115

(58) Field of Classification Search ..... 415/115, 415/116; 416/92, 95, 96 A, 96 R, 97 A, 97 R
See application file for complete search history.

(56) References Cited

U.S. PATENT DOCUMENTS 4,118,146 A * 10/1978 Dierberger ..... 416/97 A
4,183,716 A * 1/1980 Takahara et al. ..... 416/96 A
4,650,949 A 3/1987 Field
4,672,727 A 6/1987 Field
4,676,719 A 6/1987 Auxier et al.
4,684,323 A 8/1987 Field
4,738,588 A 4/1988 Field
5,609,466 A 3/1997 North et al.
5,711,650 A 1/1998 Tibbott et al.
5,720,431 A 2/1998 Sellers et al.
5,931,638 A 8/1999 Krause et al.
6,254,334 B1 7/2001 LaFleur
6,402,470 B1 6/2002 Kvasnak et al.
6,582,186 B2 6/2003 Manzoori et al.
6,769,866 B1 * 8/2004 Kannefass et al. ..... 415/115
7,390,168 B2 * 6/2008 Liang ..... 416/97 R
2005/0265838 A1 12/2005 Liang
2005/0281667 A1 12/2005 Liang
2006/0002788 A1 1/2006 Liang
2006/0222494 A1 10/2006 Liang

* cited by examiner

*Primary Examiner*—Igor Kershteyn

(57) ABSTRACT

An airfoil for a turbine of a gas turbine engine is provided comprising an outer wall structure defining at least one inner cavity adapted to receive a cooling fluid. The wall structure comprises at least one cooling fluid path circuit communicating with the at least one inner cavity. The cooling fluid path circuit comprises: at least one metering opening extending from an inner surface of the wall structure such that the metering opening communicates with the at least one inner cavity; at least one intermediate diffusion region communicating with the metering opening; an intermediate metering opening positioned downstream from the intermediate diffusion region and communicating with the intermediate diffusion region; and, an end diffusion region positioned downstream from the intermediate metering opening for communicating with the intermediate metering opening and extending to an exit in an outer surface of the wall structure.

20 Claims, 6 Drawing Sheets

TURBINE AIRFOIL WITH ENHANCED COOLING

FIELD OF THE INVENTION

The present invention relates to an airfoil for a turbine of a gas turbine engine and, more preferably, to an airfoil having improved cooling.

BACKGROUND OF THE INVENTION

A conventional combustible gas turbine engine includes a compressor, a combustor, and a turbine. The compressor compresses ambient air. The combustor combines the compressed air with a fuel and ignites the mixture creating combustion products defining a working gas. The working gases travel to the turbine. Within the turbine are a series of rows of stationary vanes and rotating blades. Each pair of rows of vanes and blades is called a stage. Typically, there are four stages in a turbine. The rotating blades are coupled to a shaft and disc assembly. As the working gases expand through the turbine, the working gases cause the blades, and therefore the shaft and disc assembly, to rotate.

Combustors often operate at high temperatures. Typical combustor configurations expose turbine vanes and blades to these high temperatures. As a result, turbine vanes and blades must be made of materials capable of withstanding such high temperatures. In addition, turbine vanes and blades often contain internal cooling systems for prolonging the life of the vanes and blades and reducing the likelihood of failure as a result of excessive temperatures.

Typically, turbine vanes comprise inner and outer endwalls and an airfoil that extends between the inner and outer endwalls. The airfoil is ordinarily composed of a leading edge and a trailing edge. The vane cooling system receives air from the compressor of the turbine engine and passes the air through the airfoil.

Conventional turbine vanes have many different designs of internal cooling systems. While many of these conventional systems have operated successfully, the cooling demands of turbine engines produced today have increased. Thus, an internal cooling system for turbine vanes as well as blades having increased cooling capabilities is desired.

SUMMARY OF THE INVENTION

In accordance with a first aspect of the present invention, an airfoil is provided for a turbine of a gas turbine engine. The airfoil comprises an outer wall structure defining at least one inner cavity adapted to receive a cooling fluid. The wall structure comprises at least one cooling fluid path circuit communicating with the at least one inner cavity comprising: first and second metering openings spaced apart from one another; first and a second diffusion regions located downstream from the first and second metering openings and communicating respectively with the first, and second metering openings; a third metering opening positioned downstream from the first and second diffusion regions and communicating with the first and second diffusion regions; and, a third diffusion region positioned downstream from the third metering opening for communicating with the third metering opening and extending to an exit in an outer surface of the wall structure. The first and second metering openings may extend from an inner surface of the wall structure such that the first and second metering openings communicate with the at least one inner cavity.

Each of the first, second and third metering openings may have a substantially constant cross sectional area along substantially its entire length.

Each of the first, second and third metering openings may have a length to hydraulic diameter ratio between about 2 and 3.

Each of the first, second and third diffusion regions expands spanwise away from a horizontal plane parallel to its corresponding longitudinal axis toward a first end of the wall structure at an angle of between about 7 and 10 degrees and expands spanwise away from a horizontal plane parallel to its corresponding longitudinal axis toward a second end of the wall structure at an angle of between about 7 and 10 degrees.

Each of the first, second and third diffusion regions expands away from a vertical plane parallel to its corresponding longitudinal axis toward an inner surface of the wall structure at an angle of between about 7 and 10 degrees.

Each of the first, second and third metering openings and the first, second and third diffusion regions has a longitudinal axis. Preferably, the longitudinal axes of the first, second and third metering openings and the first, second and third diffusion regions are generally parallel with one another.

The longitudinal axes of the first, second and third metering openings and the first, second and third diffusion regions may extend at an angle of between about 30 to about 50 degrees to an outer surface of the wall structure.

Each of the first, second and third diffusion regions has an entrance and an exit. A ratio of the cross sectional area of the exit to the cross sectional area of the entrance may be from about 2 to about 5.

The first diffusion region communicates with the first metering opening and preferably does not communicate with the second metering opening, and the second diffusion region communicates with the second metering opening and preferably does not communicate with the first metering opening.

The first and second metering openings may be spaced apart from one another in a spanwise direction and the first and second diffusion regions may be spaced apart from one another in the spanwise direction.

In accordance with a second aspect of the present invention, a vane is provided for a turbine of a gas turbine engine. The vane comprises first and second endwalls and an airfoil. The airfoil comprises an outer wall structure defining at least one inner cavity adapted to receive a cooling fluid. The wall structure may comprise first and second cooling fluid path circuits. Each of the cooling path circuits comprises: first and second metering openings spaced apart from one another; first and a second diffusion regions located downstream from the first and second metering openings and communicating respectively with the first and second metering openings; a third metering opening positioned downstream from the first and second diffusion regions and communicating with the first and second diffusion regions; and, a third diffusion region positioned downstream from the third metering opening for communicating with the third metering opening and extending to an exit in an outer surface of the wall structure. The first and second metering openings may extend from an inner surface of the wall structure such that the first and second metering openings communicate with the at least one inner cavity.

The vane may further comprise at least one impingement tube provided within the at least one cavity of the airfoil outer wall structure.

Preferably, the first and second cooling fluid path circuits are spaced apart from one another in a spanwise direction.

In accordance with a third aspect of the present invention, an airfoil for a turbine of a gas turbine engine is provided comprising an outer wall structure defining at least one inner cavity adapted to receive a cooling fluid. The wall structure comprises at least one cooling fluid path circuit communicating with the at least one inner cavity. The cooling fluid path circuit comprises: at least one metering opening extending from an inner surface of the wall structure such that the metering opening communicates with the at least one inner cavity; at least one intermediate diffusion region communicating with the metering opening; an intermediate metering opening positioned downstream from the intermediate diffusion region and communicating with the intermediate diffusion region; and, an end diffusion region positioned downstream from the intermediate metering opening for communicating with the intermediate metering opening and extending to an exit in an outer surface of the wall structure.

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
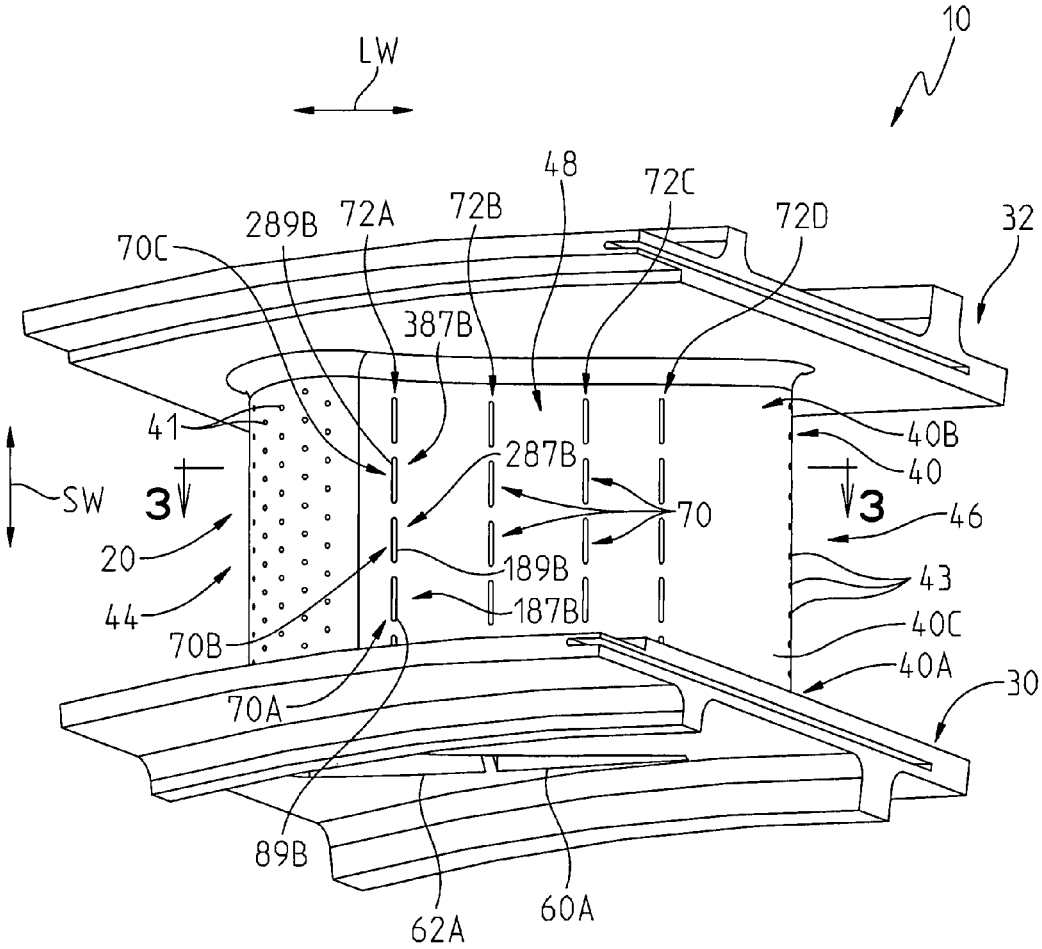
FIG. 1 is a perspective view of a vane of the present invention illustrating a pressure side of an airfoil of the vane.
Figure 2:
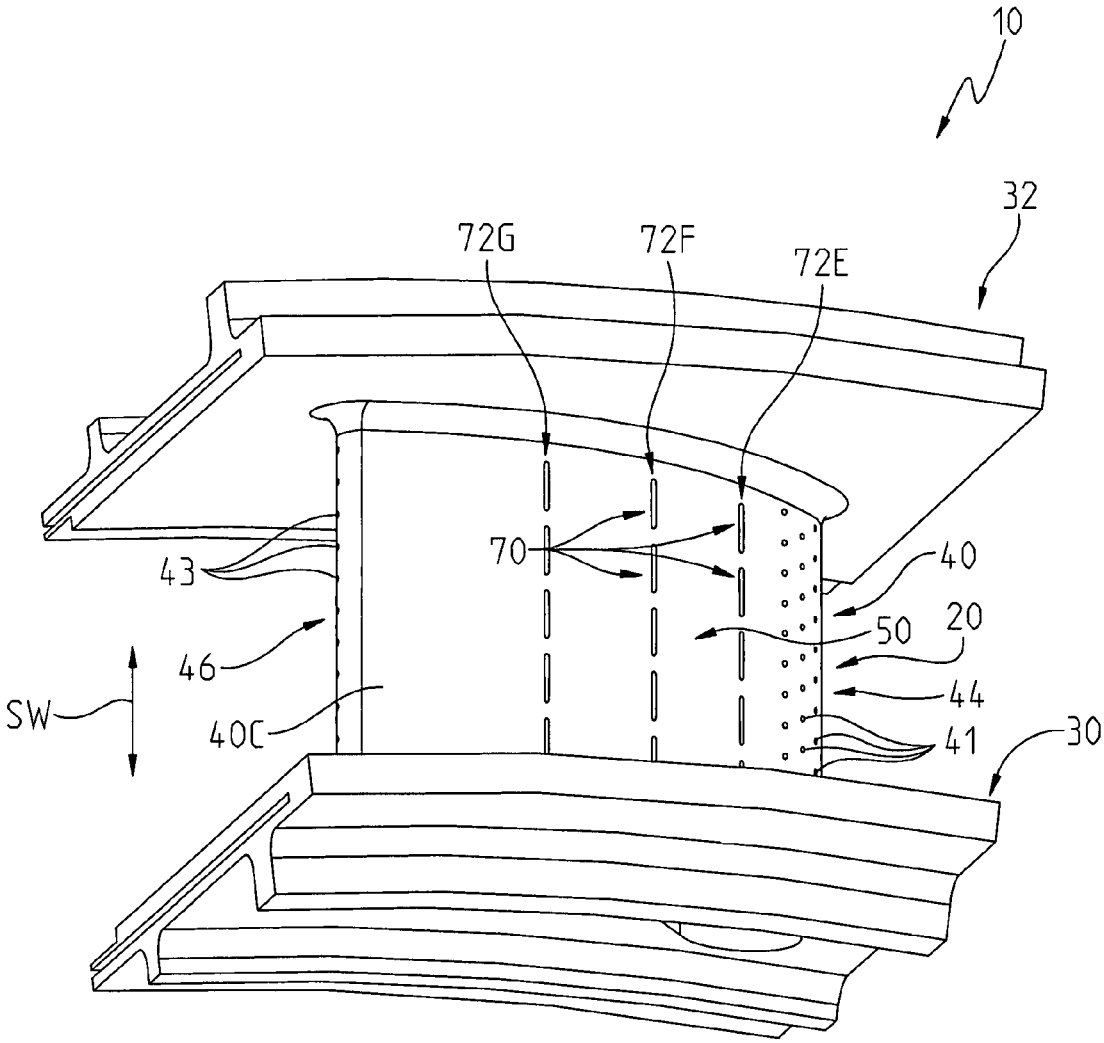
FIG. 2 is a perspective view of the vane in FIG. 1 illustrating a suction side of the airfoil.

Referring now to FIGS. 1 and 2, a vane 10 constructed in accordance with a first embodiment of the present invention is illustrated. The vane 10 is adapted to be used in a gas turbine (not shown) of a gas turbine engine (not shown). The gas turbine engine includes a compressor (not shown), a combustor (not shown), and a gas turbine (not shown). The compressor compresses ambient air. The combustor combines compressed air with a fuel and ignites the mixture creating combustion products defining a high temperature working gas. The high temperature working gases travel to the turbine. Within the turbine are a series of rows of stationary vanes and rotating blades. Each pair of rows of vanes and blades is called a stage. Typically, there are four stages in a turbine. It is contemplated that the vane 10 illustrated in FIGS. 1 and 2 may define the vane configuration for a first row of vanes in the gas turbine.

The stationary vanes and rotating blades are exposed to the high temperature working gases. To cool the vanes and blades, a cooling fluid, such as cooling air from the compressor, is provided to the vanes and the blades.

The vane 10 is defined by an airfoil 20 and first and second endwalls 30 and 32, see FIGS. 1 and 2. The airfoil 20 comprises an outer wall structure 40 defining a leading edge 44, a trailing edge 46, a concave-shaped pressure side 48, and a convex-shaped suction side 50, see FIGS. 1-3. In the illustrated embodiment, the airfoil 20 further comprises an internal wall 42 integral with the outer wall structure 40, which defines with the outer wall structure 40 first and second inner cavities 60 and 62, respectively. The first and second inner cavities 60 and 62 extend in a spanwise direction, wherein the spanwise direction is designated by arrow SW in FIGS. 1, 2 and 4, from a first end 40A of the outer wall structure 40 near the first endwall 30 to a second end 40B of the outer structure 40 near the second endwall 32, see FIG. 1. The airfoil 20 and the first and second endwalls 30 and 32 may be formed as a single integral unit from a material such as a metal alloy 247 via a conventional casting operation. A conventional thermal barrier coating (not shown) is provided on an outer surface 40C of the outer structure 40. It is also contemplated that more than one internal wall integral with the outer wall structure 40 may be provided.

In the illustrated embodiment, first and second impingement tubes 64 and 66 are provided in the first and second inner cavities 60 and 62 and welded in place to the vane 10. Each impingement tube 64 and 66 has an open end defined by a metal ring (not shown) and a closed end (not shown). The impingement tubes 64 and 66 are formed separately from the single casting comprising the airfoil 20 and the first and second endwalls 30 and 32. The first and second inner cavities 60 and 62 are adapted to receive the cooling fluid from the compressor, which cooling fluid may pass into the inner cavities 60 and 62 via openings 60A and 62A in the first endwall 30, see FIG. 1. The open end of the first impingement tube 64 is positioned adjacent to the open end 60A of the first cavity 60 and the open end of the second impingement tube 66 is positioned adjacent to the open end 62A of the second cavity 62. The cooling fluid that passes into the first and second inner cavities 60 and 62 also passes into the first and second impingement tubes 64 and 66. The cooling fluid received by the first and second impingement tubes 64 and 66 exits those impingement tubes 64 and 66 via first and second metering openings 64A and 66A provided respectively in the first and second impingement tubes 64 and 66. A jet of cooling fluid exits each metering opening 64A and 66A and impinges upon a corresponding portion 140D of an inner surface 40D of the outer structure 40 so as to cool the corresponding portion 140D, see FIG. 3.

As noted above, openings 60A and 62A are provided in the first endwall 30 to allow cooling fluid to enter the inner cavities 60 and 62. After casting the vane 10, the first and second inner cavities 60 and 62 are closed near the second end 40B of the outer wall structure 40 via one or more plates (not shown) coupled to the second endwall 32. Alternatively, the opening 60A may be provided in the second endwall 32, while the opening 62A remains in the first endwall 30. Hence, the first supply cavity 60 is closed by securing a plate to the first endwall 30 and the second supply cavity 62 is closed by securing a plate to the second endwall 32.

Incorporated into the outer wall structure 40 are a plurality of cooling fluid path circuits 70. The cooling circuits 70 receive cooling air under pressure from one of the first and second inner cavities 60 and 62 so as to effect cooling of corresponding sections of the outer wall structure 40 and corresponding downstream portions of the outer surface 40C of the wall structure 40, see FIGS. 1-3.

The cooling circuits 70 may be aligned in columns extending between the first and second endwalls 30 and 32 of the vane 10. In the illustrated embodiment, a plurality of first, second, third and fourth columns 72A-72D of cooling circuits 70 are shown incorporated into the pressure side 48 of the outer structure 40 and fifth, sixth and seventh columns 72E-72G of cooling circuits 70 are shown incorporated into the suction side 50 of the outer structure 40, see FIGS. 1-3. In FIG. 4, first, second and third cooling circuits 70A-70C in column 72A are shown. Instead of being aligned in columns, it is contemplated that the cooling circuits 70 may be offset or staggered relative to one another. The number and arrangement of the cooling circuits 70 within the wall structure 40 may vary based on the cooling requirements of the leading edge 44, trailing edge 46, pressure side 48, and suction side 59 of the outer wall structure 40.

A description of the first, second and third cooling circuits 70A-70C will be described in detail herein. The remaining cooling circuits 70 provided in columns 72A-72G may be formed having similar elements as the cooling circuits 70A-70C. However, the number, shape and size of those elements may vary for a given cooling circuit 70 based on the cooling requirements of the corresponding portion of the wall structure 40 containing that given cooling circuit 70.

The first cooling circuit 70A comprises first and second metering openings 80 and 82, spaced apart from one another in the spanwise direction; first and second diffusion regions 84 and 86 located downstream from the first and second metering openings 80 and 82 and communicating respectively with the first and second metering openings 80 and 82; a third metering opening 88 positioned downstream from the first and second diffusion regions 84 and 86 and communicating with the first and second diffusion regions 84 and 86; and, a third diffusion region 89 positioned downstream from the third metering opening 88 for communicating with the third metering opening 88. The first and second metering openings 80 and 82 extend from the inner surface 40D of the wall structure 40 such that the first and second metering openings 80 and 82 communicate with the second inner cavity 62. The third diffusion region 89 extends to an exit 89B in the outer surface 40C of the wall structure 40.

In the illustrated embodiment, each of the first, second and third metering openings 80, 82 and 88 has a substantially constant rectangular cross sectional area along its entire length. Alternatively, the first, second and third metering openings 80, 82 and 88 may have a circular, square or like cross sectional area along its length. Preferably, each of the first, second and third metering openings 80, 82 and 88 has a length to hydraulic diameter ratio of between about 2 and 3 so as to allow the flow of cooling fluid passing through each opening 80, 82 and 88 to become fully developed. The length of each metering opening 80, 82 and 84 extends in a cooling circuit direction, designated by arrow $A_{CC}$ in FIGS. 3 and 4. If the cooling fluid flow is fully developed, the flow is less likely to separate when it diffuses and spreads outward in a downstream diffusion region 84, 86 and 89. It is noted that the third metering opening 88 functions to combine flows of cooling fluid from the first and second diffusion regions 84 and 86 into a single, fully developed flow or stream so as to minimize the likelihood of the flow of fluid passing through the third diffusion region 89 from separating into separate or distinct streams of cooling fluid in the third diffusion region 89.

Each of the first, second and third metering openings 80, 82 and 88 and the first, second and third diffusion regions 84, 86 and 89 has a longitudinal axis. Only the longitudinal axis $A_{82}$ for the second metering opening 82, the longitudinal axis $A_{86}$ for the second diffusion region 86, and the longitudinal axis $A_{88}$ for the third metering opening 88 are shown in FIG. 4. The longitudinal axes of the first, second and third metering openings 80, 82 and 88 and the first, second and third diffusion regions 84, 86 and 89 are generally parallel with one another in the illustrated embodiment.

The longitudinal axes of the first, second and third metering openings 80, 82 and 88 and the first, second and third diffusion regions 84, 86 and 89 may extend at an angle of between about 30 to about 50 degrees to the outer surface 40C of the outer wall structure 40.

Each of the first, second and third diffusion regions 84, 86 and 89 preferably expands in the spanwise direction, see arrow SW in FIGS. 1, 2 and 4, away from a horizontal plane parallel to its corresponding longitudinal axis toward the first end 40A of the wall structure 40 at an angle $\theta_{A1}$ of between about 7 and 10 degrees and expands spanwise away from a horizontal plane parallel to its corresponding longitudinal axis toward the second end 40B of the wall structure 40 at an angle $\theta_{A2}$ of between about 7 and 10 degrees, see FIG. 4. Further, each of the first, second and third diffusion regions 84, 86 and 89 has an entrance 84A, 86A and 89A, and an exit 84B, 86B and 89B, see FIG. 4. A ratio of the cross sectional area of each exit 84B, 86B, 89B to the cross sectional area of its corresponding entrance 84A, 86A and 89A is preferably from about 2 to about 5. The expansion angles and exit-to-entrance ratios set out above for the first, second and third diffusion regions 84, 86 and 89 are believed to result in a flow of cooling fluid expanding within the first, second and third diffusion regions 84, 86 and 89 without separating into two or more separate streams or flows of cooling fluid. If the cooling fluid exiting the third diffusion region 89 separates into two or more streams of cooling fluid, there is risk that high temperature working gases may enter the third diffusion region 89 through the exit 89B, which is undesirable.

The present invention is believed to allow for controlled diffusion or expansion of flows of cooling fluid passing through the first and second diffusion regions 84 and 86 with reduced risk of either flow separating into two or more separate streams of cooling fluid. As noted above, it is believed that the two streams or flows of cooling fluid are combined by the third metering opening 88 into a single, fully developed flow of cooling fluid prior to reaching the third diffusion region 89. In the third diffusion region 89, it is believed that controlled diffusion or expansion of the single flow of cooling fluid occurs with reduced risk of the flow separating into two or more separate streams prior to leaving the exit 89B. The exit 89B has a cross sectional area which is approximately 9 to 25 times the summation of the cross sectional areas of the first and second metering openings 80 and 82. A single cohesive flow of cooling fluid is believed to leave the exit 89B so as to form a film of cooling fluid over a corresponding downstream portion 187B on the outer surface 40C of the outer wall structure 40, see FIG. 1. Because of the large cross sectional area of the exit 89B, including its large dimension in the spanwise direction, the cooling fluid leaving the exit 89B is believed to provide enhanced film coverage protection from the high temperature working gases moving across the outer surface 40C of the outer wall structure 40, see FIG. 1.

The first cooling circuit 70A is defined within the outer wall structure 40 by corresponding first and second wall sections (only the first wall section 90 is illustrated in FIG. 4) and first, second and third intermediate wall sections (only the second and third intermediate wall sections 94 and 96 are illustrated in FIG. 4) extending between the first and second wall sections. It is noted that the cooling fluid passing through the first, second and third metering openings 80, 82 and 88 and the first, second and third diffusion regions 84, 86 and 89 effects convective cooling of the corresponding first, second and intermediate wall sections (only the first wall section 90 and the second and third intermediate wall sections 94 and 96 are illustrated in FIG. 4) of the outer wall structure 40, i.e., heat is transferred from the corresponding first, second and intermediate wall sections of the outer wall structure 40 to the cooling fluid passing across those sections of the outer wall structure 40.

The second cooling circuit 70B comprises first and second metering openings 180 and 182, spaced apart from one another in the spanwise direction; first and second diffusion regions 184 and 186 located downstream from the first and second metering openings 180 and 182 and communicating respectively with the first and second metering openings 180 and 182; a third metering opening 188 positioned downstream from the first and second diffusion regions 184 and 186 and communicating with the first and second diffusion regions 184 and 186; and, a third diffusion region 189 positioned downstream from the third metering opening 188 for communicating with the third metering opening 188. The first and second metering openings 180 and 182 extend from the inner surface 40D of the wall structure 40 such that the first and second metering openings 180 and 182 communicate with the second inner cavity 62. The third diffusion region 189 extends to an exit 189B in the outer surface 40C of the wall structure 40.

Figure 4:
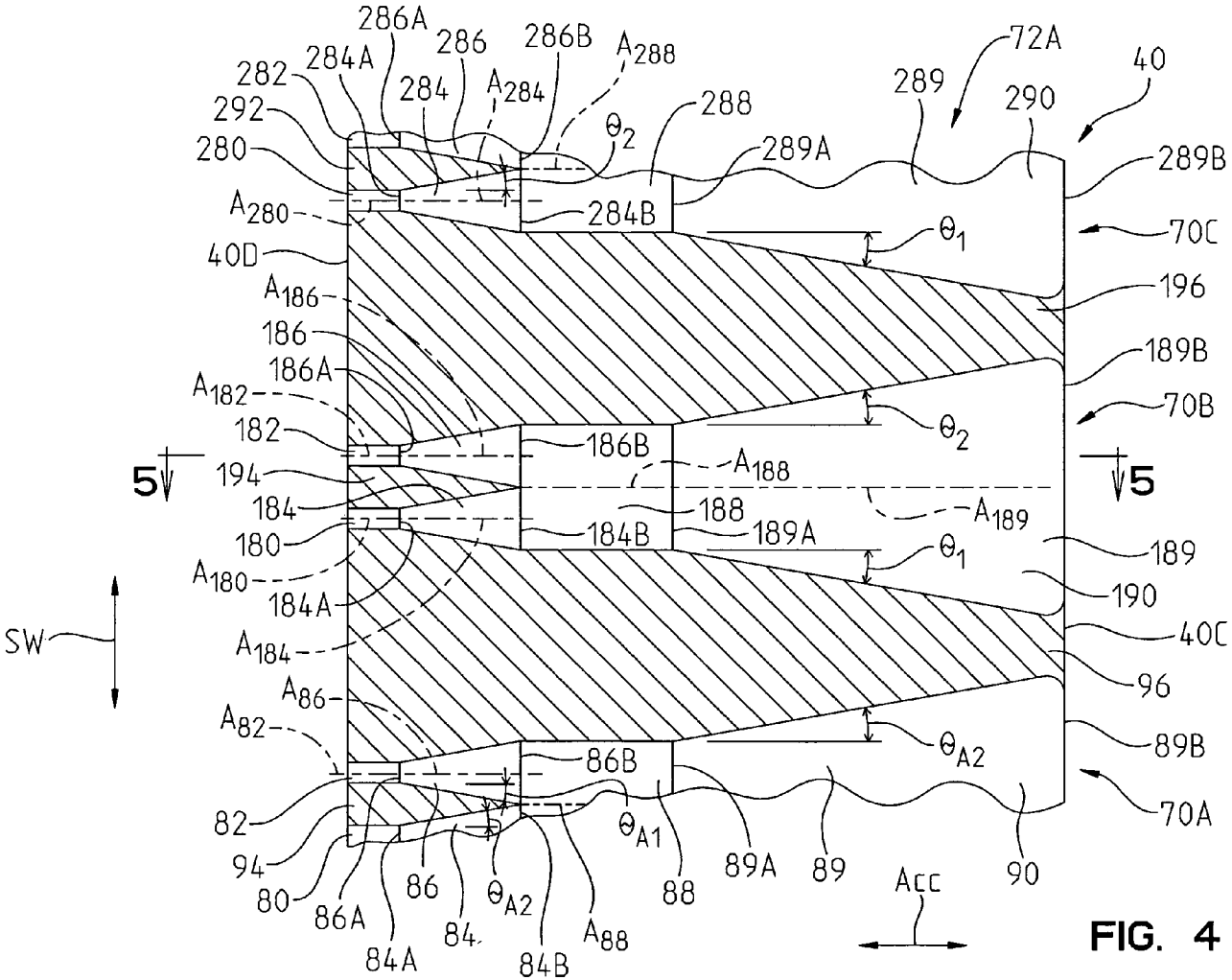
FIG. 4 is a sectional view of a portion of an outer wall structure of the airfoil of FIGS. 1-3, with sections of the outer wall structure removed to show other sections of first, second and third cooling circuits.
Figure 5:
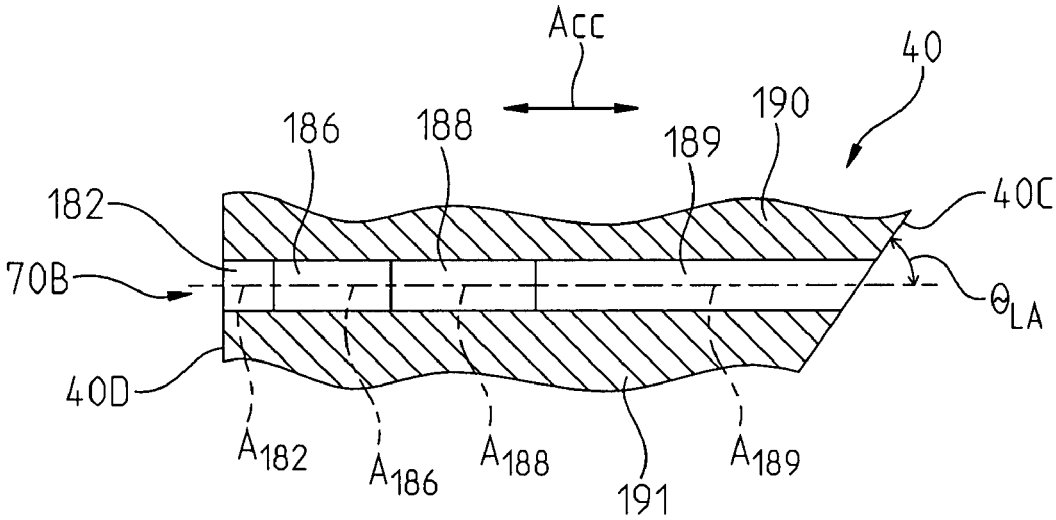
FIG. 5 is a sectional view corresponding to view line 5-5 in FIG. 4.

In the illustrated embodiment, each of the first, second and third metering openings 180, 182 and 188 has a substantially constant rectangular cross sectional area along its entire length, see FIGS. 4 and 5. Alternatively, the first, second and third metering openings 180, 182 and 188 may have a circular, square or like cross sectional area along its length. Preferably, each of the first, second and third metering openings 180, 182 and 188 has a length to hydraulic diameter ratio of between about 2 and 3 so as to allow the flow of cooling fluid passing through each opening 180, 182 and 188 to become fully developed. The length of each metering opening 180, 182 and 184 extends in the cooling circuit direction $A_{CC}$. If the cooling fluid flow is fully developed, the flow is less likely to separate when it diffuses and spreads outward in a downstream diffusion region 184, 186 and 189. It is noted that the third metering opening 188 functions to combine flows of cooling fluid from the first and second diffusion regions 184 and 186 into a single, fully developed flow or stream so as to minimize the likelihood of the flow of fluid passing through the third diffusion region 189 from separating into separate or distinct streams of cooling fluid in the third diffusion region 189.

Each of the first, second and third metering openings 180, 182 and 188 and the first, second and third diffusion regions 184, 186 and 189 has a corresponding longitudinal axis $A_{180}$, $A_{182}$, $A_{188}$, $A_{184}$, $A_{186}$, $A_{189}$. The longitudinal axes $A_{180}$, $A_{182}$, $A_{188}$, $A_{184}$, $A_{186}$, $A_{189}$ of the first, second and third metering openings 180, 182 and 188 and the first, second and third diffusion regions 184, 186 and 189 are generally parallel with one another in the illustrated embodiment, see FIGS. 4 and 5.

The longitudinal axes $A_{180}$, $A_{182}$, $A_{188}$, $A_{184}$, $A_{186}$, $A_{189}$ of the first, second and third metering openings 180, 182 and 188 and the first, second and third diffusion regions 184, 186 and 189 may extend at an angle $\theta_{LA}$ of between about 30 to about 50 degrees to the outer surface 40C of the outer wall structure 40, see FIG. 5.

Each of the first, second and third diffusion regions 184, 186 and 189 preferably expands in the spanwise direction SW away from a horizontal plane parallel to its corresponding longitudinal axis toward the first end 40A of the wall structure 40 at an angle $\theta_{A1}$ of between about 7 and 10 degrees and expands spanwise away from a horizontal plane parallel to its corresponding longitudinal axis toward the second end 40B of the wall structure 40 at an angle $\theta_{A2}$ of between about 7 and 10 degrees, see FIG. 4. Further, each of the first, second and third diffusion regions 184, 186 and 189 has an entrance 184A, 186A and 189A, and an exit 184B, 186B and 189B, see FIG. 4. A ratio of the cross sectional area of each exit 184B, 186B, 189B to the cross sectional area of its corresponding entrance 184A, 186A and 189A is preferably from about 2 to about 5. The expansion angles and exit-to-entrance ratios set out above for the first, second and third diffusion regions 184, 186 and 189 are believed to result in a flow of cooling fluid expanding within the first, second and third diffusion regions 184, 186 and 189 without separating into two or more separate streams or flows of cooling fluid. If the cooling fluid exiting the third diffusion region 189 separates into two or more streams of cooling fluid, there is risk that high temperature working gases may enter the third diffusion region 189 through the exit 189B, which is undesirable.

It is believed that controlled diffusion or expansion of flows of cooling fluid passing through the first and second diffusion regions 184 and 186 occurs with reduced risk of either flow separating into two or more separate streams of cooling fluid. As noted above, it is believed that the two streams or flows of cooling fluid are combined by the third metering opening 188 into a single, fully developed flow of cooling fluid prior to reaching the third diffusion region 189. In the third diffusion region 189, it is believed that controlled diffusion or expansion of the single flow of cooling fluid occurs with reduced risk of the flow separating into two or more separate streams prior to leaving the exit 189B. The exit 189B has a cross sectional area which is approximately 9 to 25 times the summation of the cross sectional areas of the first and second metering openings 180 and 182. A single cohesive flow of cooling fluid is believed to leave the exit 189B so as to form a film of cooling fluid over a corresponding downstream portion 287B on the outer surface 40C on the outer wall structure 40, see FIG. 1. Because of the large cross sectional area of the exit 189B, including its large dimension in the spanwise direction, the cooling fluid leaving the exit 189B is believed to provide enhanced film coverage protection from the high temperature working gases moving across the outer surface 40C of the outer wall structure 40, see FIG. 1.

The second cooling circuit 70B is defined within the outer wall structure 40 by corresponding first and second wall sections 190 and 191 and first, second and third intermediate wall sections 96, 194 and 196 extending between the first and second wall sections, see FIGS. 4 and 5. The first intermediate wall section 96 is the same as the third intermediate wall section for the first cooling circuit 70A. It is noted that the cooling fluid passing through the first, second and third metering openings 180, 182 and 188 and the first, second and third diffusion regions 184, 186 and 189 effects convective cooling of the corresponding first, second and intermediate wall sections 190, 191, 96, 194 and 196 of the outer wall structure 40, i.e., heat is transferred from the corresponding first, second and intermediate wall sections 190, 191, 96, 194 and 196 of the outer wall structure 40 to the cooling fluid passing across those sections of the outer wall structure 40.

The third cooling circuit 70C comprises first and second metering openings 280 and 282, spaced apart from one another in the spanwise direction; first and second diffusion regions 284 and 286 located downstream from the first and second metering openings 280 and 282 and communicating respectively with the first and second metering openings 280 and 282; a third metering opening 288 positioned downstream from the first and second diffusion regions 284 and 286 and communicating with the first and second diffusion regions 284 and 286; and, a third diffusion region 289 positioned downstream from the third metering opening 288 for communicating with the third metering opening 288. The first and second metering openings 280 and 282 extend from the inner surface 40D of the wall structure 40 such that the first and second metering openings 280 and 282 communicate with the second inner cavity 62. The third diffusion region 289 extends to an exit 289B in the outer surface 40C of the wall structure 40.

In the illustrated embodiment, each of the first, second and third metering openings 280, 282 and 288 has a substantially constant-rectangular cross sectional area along its entire length, see FIG. 4. Alternatively, the first, second and third metering openings 280, 282 and 288 may have a circular, square or like cross sectional area along its length. Preferably, each of the first, second and third metering openings 280, 282 and 288 has a length to hydraulic diameter ratio of between about 2 and 3 so as to allow the flow of cooling fluid passing through each opening 280, 282 and 288 to become fully developed. The length of each metering opening 280, 282 and 284 extends in the cooling circuit direction $A_{CC}$. If the cooling fluid flow is fully developed, the flow is less likely to separate when it diffuses and spreads outward in a downstream diffusion region 284, 286 and 289. It is noted that the third metering opening 288 functions to combine flows of cooling fluid from the first and second diffusion regions 284 and 286 into a single, fully developed flow or stream so as to minimize the likelihood of the flow of fluid passing through the third diffusion region 289 from separating into separate or distinct streams of cooling fluid in the third diffusion region 289.

Each of the first, second and third metering openings 280, 282 and 288 and the first, second and third diffusion regions 284, 286 and 289 has a longitudinal axis. Only the longitudinal axis $A_{280}$ for the first metering opening 280, the longitudinal axis $A_{284}$ for the first diffusion region 284, and the longitudinal axis $A_{288}$ for the third metering opening 288 are shown in FIG. 4. The longitudinal axes of the first, second and third metering openings 280, 282 and 288 and the first, second and third diffusion regions 284, 286 and 289 are generally parallel with one another in the illustrated embodiment.

Figure 3:
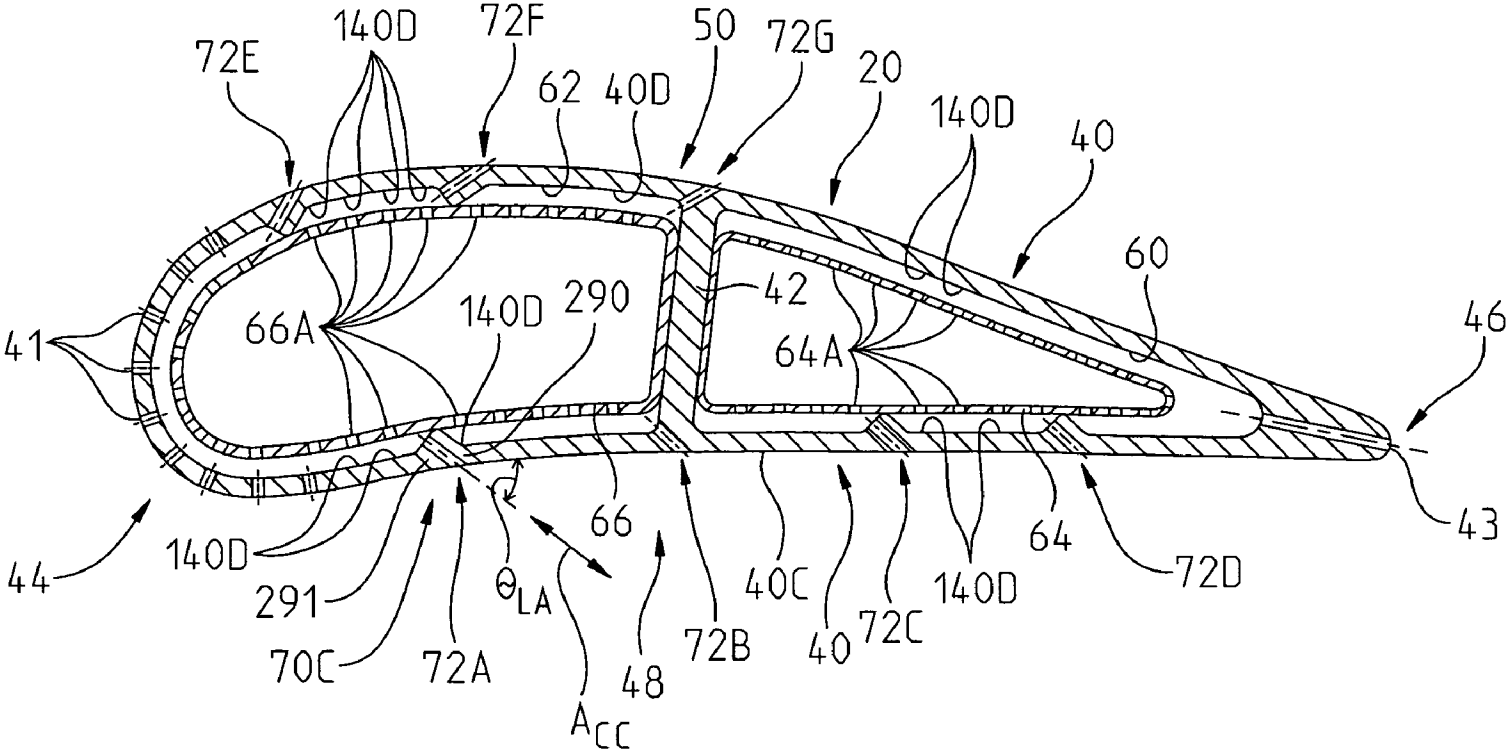
FIG. 3 is a sectional view taken along view line 3-3 in FIG. 1.

The longitudinal axes of the first, second and third metering openings 280, 282 and 288 and the first, second and third diffusion regions 284, 286 and 289 may extend at an angle of between about 30 to about 50 degrees to the outer surface 40C of the outer wall structure 40, see FIG. 3.

Each of the first, second and third diffusion regions 284, 286 and 289 preferably expands in the spanwise direction SW away from a horizontal plane parallel to its corresponding longitudinal axis toward a first end 40A of the wall structure 40 at an angle $\theta_{A1}$ of between about 7 and 10 degrees and expands spanwise away from a horizontal plane parallel to its corresponding longitudinal axis toward the second end 40B of the wall structure 40 at an angle $\theta_{A2}$ of between about 7 and 10 degrees, see FIG. 4. Further, each of the first, second and third diffusion regions 284, 286 and 289 has an entrance 284A, 286A and 289A, and an exit 284B, 286B and 289B, see FIG. 4. A ratio of the cross sectional area of each exit 284B, 286B, 289B to the cross sectional area of its corresponding entrance 284A, 286A and 289A is preferably from about 2 to about 5. The expansion angles and exit-to-entrance ratios set out above for the first, second and third diffusion regions 284, 286 and 289 are believed to result in a flow of cooling fluid expanding within the first, second and third diffusion regions 284, 286 and 289 without separating into two or more separate streams or flows of cooling fluid. If the cooling fluid exiting the third diffusion region 289 separates into two or more streams of cooling fluid, there is risk that high temperature working gases may enter the third diffusion region 289 through the exit 289B, which is undesirable.

It is believed that controlled diffusion or expansion of flows of cooling fluid passing through the first and second diffusion regions 284 and 286 occurs with reduced risk of either flow separating into two or more separate streams of cooling fluid. As noted above, it is believed that the two streams or flows of cooling fluid are combined by the third metering opening 288 into a single, fully developed flow of cooling fluid prior to reaching the third diffusion region 289. In the third diffusion region 289, it is believed that controlled diffusion or expansion of the single flow of cooling fluid occurs with reduced risk of the flow separating into two or more separate streams prior to leaving the exit 289B. The exit 289B has a cross sectional area which is approximately 9 to 25 times the summation of the cross sectional areas of the first and second metering openings 280 and 282. A single cohesive flow of cooling fluid is believed to leave the exit 289B so as to form a film of cooling fluid over a corresponding downstream portion 387B on the outer surface 40C on the outer wall structure 40, see FIG. 1. Because of the large cross sectional area of the exit 289B, including its large dimension in the spanwise direction, the cooling fluid leaving the exit 289B is believed to provide enhanced film coverage protection from the high temperature working gases moving across the outer surface 40C of the outer wall structure 40, see FIG. 1.

The third cooling circuit 70C is defined within the outer wall structure 40 by corresponding first and second wall sections 290 and 291, see FIG. 3, and first, second and third intermediate wall sections (only the first and second intermediate wall sections 196 and 292 are illustrated in FIG. 4) extending between the first and second wall sections. The first intermediate wall section 196 in the third cooling circuit 70C is the same as the third intermediate wall section 196 of the second cooling circuit 70B. It is noted that the cooling fluid passing through the first, second and third metering openings 280, 282 and 288 and the first, second and third diffusion regions 284, 286 and 289 effects convective cooling of the corresponding first, second and intermediate wall sections (only the first and second intermediate wall sections 196 and 292 are illustrated in FIG. 4) of the outer wall structure 40, i.e., heat is transferred from the corresponding first, second and intermediate wall sections of the outer wall structure 40 to the cooling fluid passing across those sections of the outer wall structure 40.

It is contemplated that each cooling fluid path circuit 70 may be formed in the outer wall structure 40 by electro-discharge machining using a conventional sheet metal electrode, as discussed in U.S. Pat. No. 4,650,949, the entire disclosure of which is incorporated herein by reference.

It is further contemplated that one or more cooling fluid path circuits 70 may comprise one or more than two initial metering openings communicating with an inner cavity 60, 62 and one or more than two intermediate diffusion regions communicating with the one or more than two metering openings communicating with the inner cavity 60, 62. An intermediate metering opening communicates with the one or more than two intermediate diffusion regions and an end diffusion region having an exit in the outer surface 40C of the outer wall structure 40.

The wall structure 40 further comprises a plurality of bores 41 extending completely through the wall structure 40 and located at the leading edge 44 of the wall structure 40, see FIGS. 1-3. Cooling air passes from the second inner cavity 62 through the bores 41. The wall structure 40 further comprises a plurality of bores 43 extending completely through the wall structure 40 and located at the trailing end 46 of the wall structure 40, see FIGS. 1-3. Cooling air passes from the first inner cavity 60 through the bores 43.

Figure 6:
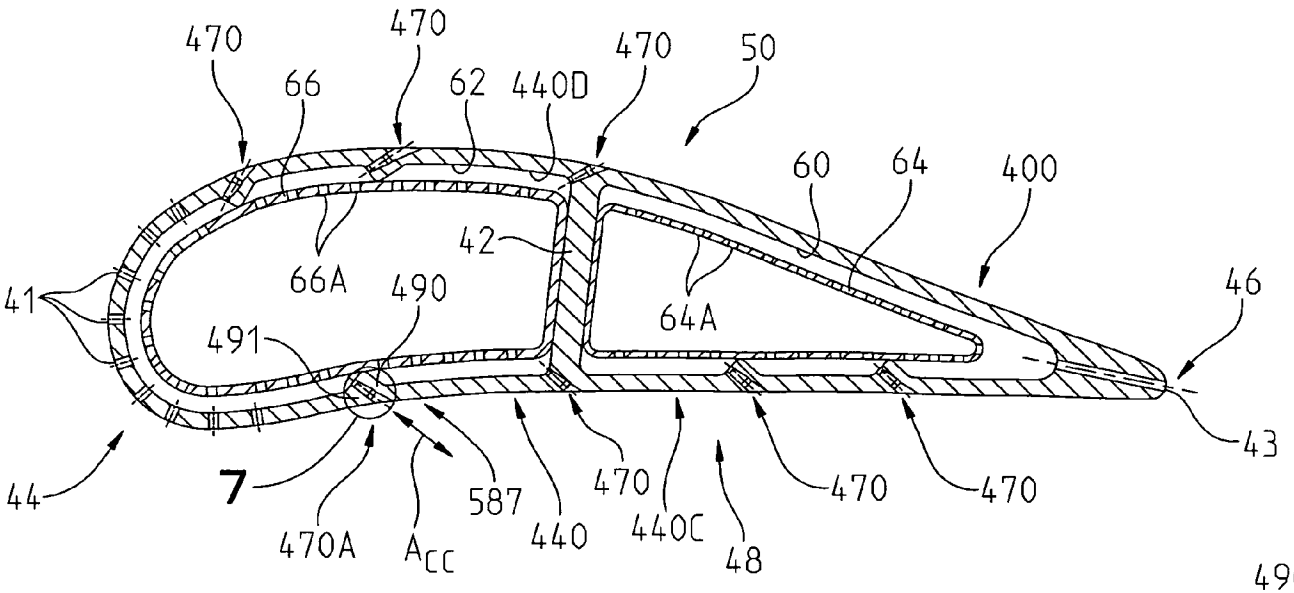
FIG. 6 is a sectional view of an airfoil configured in accordance with an alternative embodiment of the present invention.

A vane 400 constructed in accordance with an alternative embodiment, where like elements are referenced by like reference numerals, is illustrated in FIG. 6. The vane comprises a plurality of cooling circuits 470. One cooling circuit 470A illustrated in FIGS. 6 and 7 will now be specifically described. All remaining cooling circuits 470 in the vane 400 may be constructed in the same manner as the cooling circuit 470A.

Figure 7:
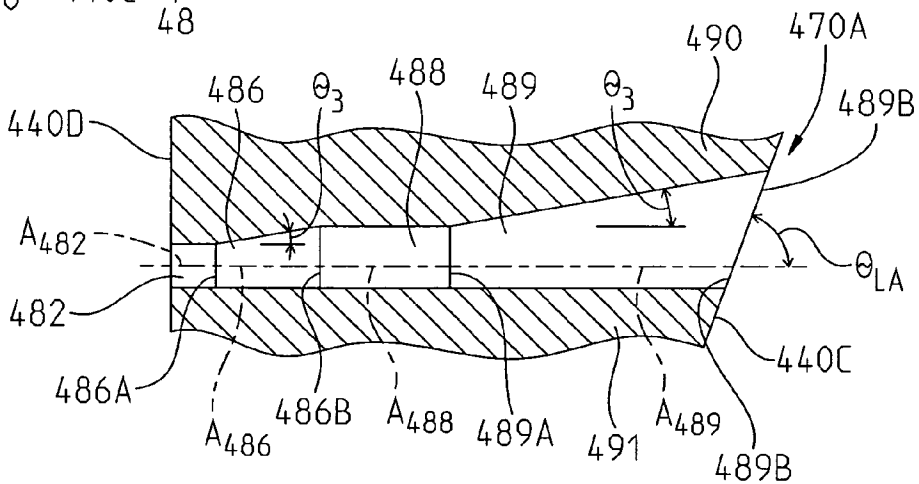
FIG. 7 is an enlarged view of a portion of the airfoil labeled FIG. 7 in FIG. 6.

Cooling circuit 470A comprises first and second metering openings (only a second metering opening 482 is illustrated in FIG. 7), spaced apart from one another in the spanwise direction; first and second diffusion regions (only a second diffusion region 486 is illustrated in FIG. 7) spaced apart from one another in the spanwise direction, located downstream from the first and second metering openings and communicating respectively with the first and second metering openings; a third metering opening 488 positioned downstream from the first and second diffusion regions and communicating with the first and second diffusion regions; and, a third diffusion region 489 positioned downstream from the third metering opening 488 for communicating with the third metering opening 488. The first and second metering openings extend from an inner surface 440D of an outer wall structure 440 such that the first and second metering openings communicate with the second inner cavity 62. The third diffusion region 489 extends to an exit 489B in an outer surface 440C of the wall structure 440.

In the illustrated embodiment, each of the first, second and third metering openings has a substantially constant rectangular cross sectional area along its entire length, see FIG. 7. Alternatively, the first, second and third metering openings may have a circular, square or like cross sectional area along its length. Preferably, each of the first, second and third metering openings has a length to hydraulic diameter ratio of between about 2 and 3 so as to allow the flow of cooling fluid passing through each opening to become fully developed. The length of each metering opening extends in the cooling circuit direction $A_{CC}$. If the cooling fluid flow is fully developed, the flow is less likely to separate when it diffuses and spreads outward in a downstream diffusion region. It is noted that the third metering opening 488 functions to combine flows of cooling fluid from the first and second diffusion regions into a single, fully developed flow or stream so as to minimize the likelihood of the flow of fluid passing through the third diffusion region 489 from separating into separate or distinct streams of cooling fluid in the third diffusion region 489.

Each of the first, second and third metering openings and the first, second and third diffusion regions has a corresponding longitudinal axis. Only the axis $A_{482}$ for the second metering opening 482, the axis $A_{486}$ for the second diffusion region 486, the axis $A_{488}$ for the third metering opening 488 and the axis $A_{489}$ for the third diffusion region 489 are illustrated in FIG. 7. The longitudinal axes of the first, second and third metering openings and the first, second and third diffusion regions are generally parallel with one another in the illustrated embodiment, see FIG. 7.

The longitudinal axes of the first, second and third metering openings and the first, second and third diffusion regions may extend at an angle $\theta_{LA}$ of between about 30 to about 50 degrees to the outer surface 440C of the outer wall structure 440, see FIG. 7.

Each of the first, second and third diffusion regions preferably expands in the spanwise direction away from a horizontal plane parallel to its corresponding longitudinal axis toward the first end of the wall structure 440 at an angle of between about 7 and 10 degrees and expands spanwise away from a horizontal plane parallel to its corresponding longitudinal axis toward the second end of the wall structure 440 at an angle of between about 7 and 10 degrees. The first and second ends of the wall structure 440 are located adjacent to the first and second endwalls 30 and 32. Further, each of the first, second and third diffusion regions preferably expands away from a vertical plane parallel to its corresponding longitudinal axis toward the trailing end 46 of the wall structure 440 at an angle of between about 7 and 10 degrees.

Each of the first, second and third diffusion regions has an entrance (only the entrances 486A and 489A of the second and third diffusion regions 486 and 489 are illustrated in FIG. 7), and an exit (only the exits 486B and 489B of the second and third diffusion regions 486 and 489 are illustrated in FIG. 7). A ratio of the cross sectional area of each exit to the cross sectional area of its corresponding entrance is preferably from about 2 to about 5.

The expansion angles and exit-to-entrance ratios set out above for the first, second and third diffusion regions are believed to result in a flow of cooling fluid expanding within the first, second and third diffusion regions without separating into two or more separate streams or flows of cooling fluid. If the cooling fluid exiting the third diffusion region 489 separates into two or more streams of cooling fluid, there is risk that high temperature working gases may enter the third diffusion region 489 through the exit 489B, which is undesirable.

It is believed that controlled diffusion or expansion of flows of cooling fluid passing through the first and second diffusion regions occurs with reduced risk of either flow separating into two or more separate streams of cooling fluid. As noted above, it is believed that the two streams or flows of cooling fluid are combined by the third metering opening 488 into a single, fully developed flow of cooling fluid prior to reaching the third diffusion region 489. In the third diffusion region 489, it is believed that controlled diffusion or expansion of the single flow of cooling fluid occurs with reduced risk of the flow separating into two or more separate streams prior to leaving the exit 489B. The exit 489B has a cross sectional area which is approximately 9 to 25 times the summation of the cross sectional areas of the first and second metering openings. A single cohesive flow of cooling fluid is believed to leave the exit 489B so as to form a film of cooling fluid over a corresponding downstream portion 587 on the outer surface 440C on the outer wall structure 440, see FIG. 6. Because of the large cross sectional area of the exit 489B, including it large dimension in the spanwise direction, the cooling fluid leaving the exit 489B is believed to provide enhanced film coverage protection from the high temperature working gases moving across the outer surface 440C of the outer wall structure 440.

The cooling circuit 470A is defined within the outer wall structure 440 by corresponding first and second wall sections 490 and 491 and first, second and third intermediate wall sections (not shown). It is noted that the cooling fluid passing through the first, second and third metering openings and the first, second and third diffusion regions effects convective cooling of the corresponding first, second and intermediate wall sections of the outer wall portion 440.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An airfoil for a turbine of a gas turbine engine comprising:

an outer wall structure defining at least one inner cavity adapted to receive a cooling fluid, said wall structure comprising at least one cooling fluid path circuit communicating with said at least one inner cavity comprising:

first and second metering openings spaced apart from one another, said first and second metering openings extending from an inner surface of said wall structure such that said first and second metering openings communicate with said at least one inner cavity;

first and a second diffusion regions located downstream from said first and second metering openings and communicating respectively with said first and second metering openings;

a third metering opening positioned downstream from said first and second diffusion regions and communicating with said first and second diffusion regions;

and, a third diffusion region positioned downstream from said third metering opening for communicating with said third metering opening and extending to an exit in an outer surface of said wall structure.

2. The airfoil of claim 1, wherein each of said first, second and third metering openings has a substantially constant cross sectional area along substantially its entire length.

3. The airfoil of claim 1, wherein each of said first, second and third metering openings has a length to hydraulic diameter ratio of between about 2 and 3.

4. The airfoil of claim 1, where each of said first, second and third diffusion regions expands spanwise away from a horizontal plane parallel to its corresponding longitudinal axis toward a first end of said wall structure at an angle of between about 7 and 10 degrees and expands spanwise away from a horizontal plane parallel to its corresponding longitudinal axis toward a second end of said wall structure at an angle of between about 7 and 10 degrees.

5. The airfoil of claim 4, where each of said first, second and third diffusion regions expands away from a vertical plane parallel to its corresponding longitudinal axis toward an inner surface of said wall structure at an angle of between about 7 and 10 degrees.

6. The airfoil of claim 1, wherein each of said first, second and third metering openings and said first, second and third diffusion regions has a longitudinal axis and said longitudinal axes of said first, second and third metering openings and said first, second and third diffusion regions are generally parallel with one another.

7. The airfoil of claim 6, wherein said longitudinal axes of said first, second and third metering openings and said first, second and third diffusion regions extend at an angle of between about 30 to about 50 degrees to an outer surface of said wall structure.

8. The airfoil of claim 1, wherein each of said first, second and third diffusion regions has an entrance and an exit, a ratio of the cross sectional area of the exit to the cross sectional area of the entrance is from about 2 to about 5.

9. The airfoil of claim 1, wherein said first diffusion region communicates with said first metering opening and not said second metering opening and said second diffusion region communicates with said second metering opening and not said first metering opening.

10. The airfoil of claim 1, wherein said first and second metering openings are spaced apart from one another in a spanwise direction and said first and second diffusion regions are spaced apart from one another in the spanwise direction.

11. A vane for a turbine of a gas turbine engine comprising:

first and second endwalls; and an airfoil comprising:

an outer wall structure defining at least one inner cavity adapted to receive a cooling fluid, said wall structure comprising first and second cooling fluid path circuits, each of said circuits comprising:

first and second metering openings spaced apart from one another, said first and second metering openings extending from an inner surface of said wall structure such that said first and second metering openings communicate with said at least one inner cavity;

first and a second diffusion regions located downstream from said first and second metering openings and communicating respectively with said first and second metering openings;

a third metering opening positioned downstream from said first and second diffusion regions and communicating with said first and second diffusion regions;

and, a third diffusion region positioned downstream from said third metering opening for communicating with said third metering opening and extending to an exit in an outer surface of said wall structure.

12. The vane of claim 11, further comprising at least one impingement tube provided within said at least one cavity.

13. The vane of claim 11, wherein each of said first, second and third metering openings in each of said first and second cooling fluid path circuits has a substantially constant cross sectional area along substantially its entire length.

14. The vane of claim 11, wherein each of said first, second and third metering openings in each of said first and second cooling fluid path circuits has a length to hydraulic diameter ratio between about 2 and 3.

15. The vane of claim 11, where each of said first, second and third diffusion regions in each of said first and second cooling fluid path circuits expands spanwise away from a horizontal plane parallel to its corresponding longitudinal axis toward a first end of said wall structure at an angle of between about 7 and 10 degrees and expands spanwise away from a horizontal plane parallel to its corresponding longitudinal axis toward a second end of said wall structure at an angle of between about 7 and 10 degrees.

16. The vane of claim 15, where each of said first, second and third diffusion regions in each of said first and second cooling fluid path circuits expands away from a vertical plane parallel to its corresponding longitudinal axis toward an inner surface of said wall structure at an angle of between about 7 and 10 degrees.

17. The vane of claim 11, wherein each of said first, second and third metering openings and said first, second and third diffusion regions in each of said first and second cooling fluid path circuits has a longitudinal axis and said longitudinal axes of said first, second and third metering openings and said first, second and third diffusion regions in each of said first and second cooling fluid path circuits are generally parallel with one another.

18. The vane of claim 11, wherein each of said first, second and third diffusion regions in each of said first and second cooling fluid path circuits has an entrance and an exit, a ratio of the cross sectional area of the exit to the cross sectional area of the entrance is from about 2 to about 5.

19. The vane of claim 11, wherein said first and second cooling fluid path circuits are spaced apart from one another in a spanwise direction.

20. An airfoil for a turbine of a gas turbine engine comprising:

an outer wall structure defining at least one inner cavity adapted to receive a cooling fluid, said wall structure comprising at least one cooling fluid path circuit communicating with said at least one inner cavity comprising:

at least one metering opening extending from an inner surface of said wall structure such that said metering opening communicates with said at least one inner cavity;

at least one intermediate diffusion region communicating with said metering opening;

an intermediate metering opening positioned downstream from said intermediate diffusion region and communicating with said intermediate diffusion region;

and, an end diffusion region positioned downstream from said intermediate metering opening for communicating with said intermediate metering opening and extending to an exit in an outer surface of said wall structure.

* * * * *